US010886647B2

(12) United States Patent
Wang et al.

(10) Patent No.: US 10,886,647 B2
(45) Date of Patent: Jan. 5, 2021

(54) ELECTRONIC CIRCUITRY SOCKET STRUCTURE

(71) Applicant: International Business Machines Corporation, Armonk, NY (US)

(72) Inventors: Wei Wang, Shenzhen (CN); WeiFeng Zhang, Shenzhen (CN); YanLong Hou, Shenzhen (CN); Ben Wu, Shenzhen (CN); Miao Zhang, Shenzhen (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/201,367

(22) Filed: Nov. 27, 2018

(65) Prior Publication Data

US 2020/0169017 A1 May 28, 2020

(51) Int. Cl.

| | |
|---|---|
| ***H01R 12/00*** | (2006.01) |
| ***H01R 12/71*** | (2011.01) |
| ***H01R 12/70*** | (2011.01) |
| ***H01R 13/506*** | (2006.01) |
| ***H01R 43/20*** | (2006.01) |
| ***H01R 13/24*** | (2006.01) |

(52) U.S. Cl.

CPC ..... *H01R 12/716* (2013.01); *H01R 12/707* (2013.01); *H01R 12/7023* (2013.01); *H01R 12/7064* (2013.01); *H01R 12/7076* (2013.01); *H01R 13/24* (2013.01); *H01R 13/506* (2013.01); *H01R 43/205* (2013.01)

(58) Field of Classification Search

CPC ..... H01R 12/716; H01R 12/7023; H01R 12/7064; H01R 12/707; H01R 12/7076; H01R 13/24; H01R 13/506; H01R 43/205

USPC ..... 439/66, 78, 81

See application file for complete search history.

(56) References Cited

U.S. PATENT DOCUMENTS

| | | | |
|---|---|---|---|
| 5,984,693 | A | 11/1999 | McHugh |
| 6,227,869 | B1 | 5/2001 | Lin |
| 6,257,899 | B1 | 7/2001 | Walkup |
| 6,280,222 | B1 | 8/2001 | Walkup |
| 6,913,468 | B2 | 7/2005 | Dozier |
| 7,059,869 | B2 | 6/2006 | Wertz |
| 7,112,068 | B2 | 9/2006 | Ma |

(Continued)

FOREIGN PATENT DOCUMENTS

| | | | |
|---|---|---|---|
| CN | 101578932 | B | 8/2012 |
| CN | 104600489 | B | 4/2017 |

(Continued)

*Primary Examiner* — Khiem M Nguyen
(74) *Attorney, Agent, or Firm* — Grant M. McNeilly

(57) ABSTRACT

According to some embodiments, a socket for an electronic device includes a housing and pins connected to the housing. The housing includes a base extending laterally and having an inner face and an outer face; a riser connected to the base and extending away from the outer face; a wall extending laterally, connected to the riser, and having an exterior face and an interior face that faces the outer face of the base; mounting ports extending through the base from the inner face to the outer face; and exit ports extending through the wall from the interior face to the exterior face. Each pin includes a portion extending at least partially though one mounting port; a portion extending between the base and the wall; and a portion extending through one exit port.

17 Claims, 5 Drawing Sheets

(56) References Cited

U.S. PATENT DOCUMENTS

| | | | | |
|---|---|---|---|---|
| 7,455,556 | B2 * | 11/2008 | Mendenhall | H01R 12/57 439/495 |
| 7,575,461 | B2 | 8/2009 | Fan | |
| 7,661,966 | B2 | 2/2010 | Ohanesian | |
| 7,695,288 | B2 | 4/2010 | Ma | |
| 9,225,128 | B2 | 12/2015 | Yap | |
| 9,553,382 | B2 | 1/2017 | Sun et al. | |
| 9,590,345 | B2 * | 3/2017 | Wollitzer | H01R 13/2421 |
| 10,148,024 | B2 * | 12/2018 | Ju | H01R 12/7082 |
| 2005/0124183 | A1 | 6/2005 | Hou | |
| 2006/0046530 | A1 | 3/2006 | Wang | |
| 2007/0281507 | A1 | 12/2007 | Liao | |
| 2017/0310031 | A1 | 10/2017 | Fan | |

FOREIGN PATENT DOCUMENTS

| | | | |
|---|---|---|---|
| EP | 1401251 | B1 | 11/2005 |
| WO | 2012057767 | A1 | 5/2012 |

* cited by examiner

ELECTRONIC CIRCUITRY SOCKET STRUCTURE

BACKGROUND

A land grid array (LGA) socket can be used to connect an integrated circuit (such as a central processing unit (CPU)) to a substrate to form a printed circuit board (PCB). Traditionally, an LGA has an array of socket pins that extend outward in order to make an electrical connection with a CPU. For space-efficiency, the pins are traditionally very small, which can make them prone to being damaged. If an LGA socket pin is damaged during the manufacturing of a PCB, the damage can be difficult to detect. Even if it is detected, a damaged pin can be time consuming and costly to repair, assuming that a repair is feasible. If not, the entire PCB board may need to be scrapped.

SUMMARY

According to some embodiments, a socket for an electronic device includes a housing and pins connected to the housing. The housing includes a base extending laterally and having an inner face and an outer face; a riser connected to the base and extending away from the outer face; a wall extending laterally, connected to the riser, and having an exterior face and an interior face that faces the outer face of the base; mounting ports extending through the base from the inner face to the outer face; and exit ports extending through the wall from the interior face to the exterior face. Each pin includes a portion extending at least partially though one mounting port; a portion extending between the base and the wall; and a portion extending through one exit port.

According to some embodiments, an apparatus includes a substrate having conductive tracks and a socket mounted to the substrate and configured to connect to an electronic device. The socket includes a housing with a base including a first array of ports; a riser connected to the base and extending therefrom; and a wall connected to the base, extending therefrom, and spaced apart from the base, the wall including a second array of ports. The socket also includes pins, wherein each of the plurality of pins is positioned in one of the first array of ports and one of the second array of ports.

According to some embodiments, a method includes press-fitting pins into mounting ports in a base of a socket configured to accept an electronic device; placing a wall having through ports onto the pins; and connecting the wall to a riser that is connected to the base such that the wall is spaced apart from the base.

DETAILED DESCRIPTION

Figure 1:
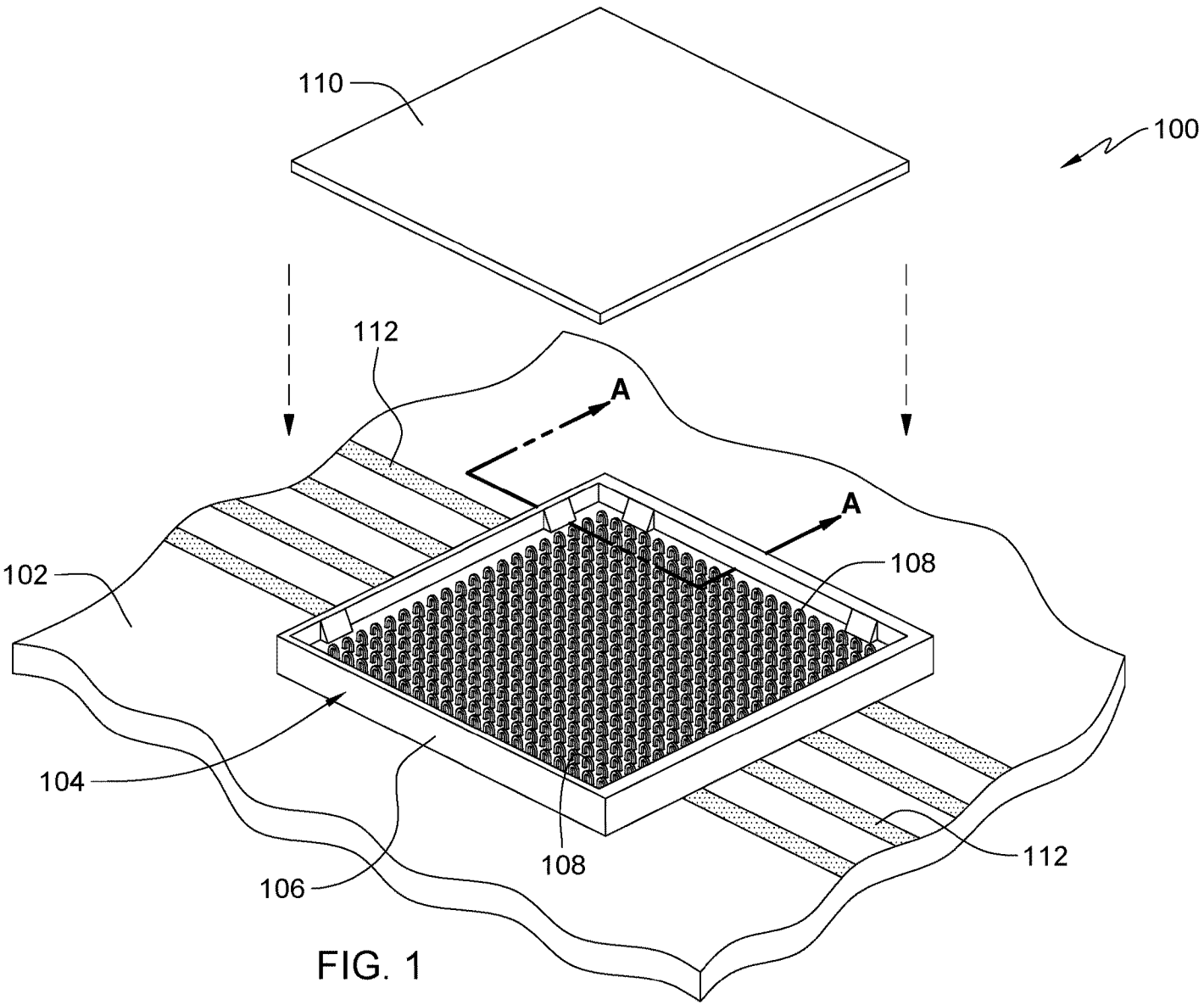
FIG. 1 shows perspective view of a PCB with a substrate, a socket, and a disconnected CPU.

FIG. 1 shows perspective view of PCB 100. PCB 100 includes substrate 102 with socket 104 mounted thereto. In the illustrated embodiment, socket 104 comprises housing 106 and an array of pins 108. Offset from socket 104 is a disconnected CPU 110. CPU 110 can be connected to socket 104 by moving CPU 110 along direction D until CPU 110 locks into socket 104. Such an action would electrically connect CPU 110 with pins 108. Because the array of pins 108 are electrically connected with conductive tracks 112 on substrate 102, CPU 110 can be electrically connected to other components of PCB 100 (not shown). Thereby, the components and configuration of PCB 100 allow CPU 110 to be manufactured separately from the other components of PCB 100 while still being able to communicate therewith once installed in socket 104.

Figure 2A:
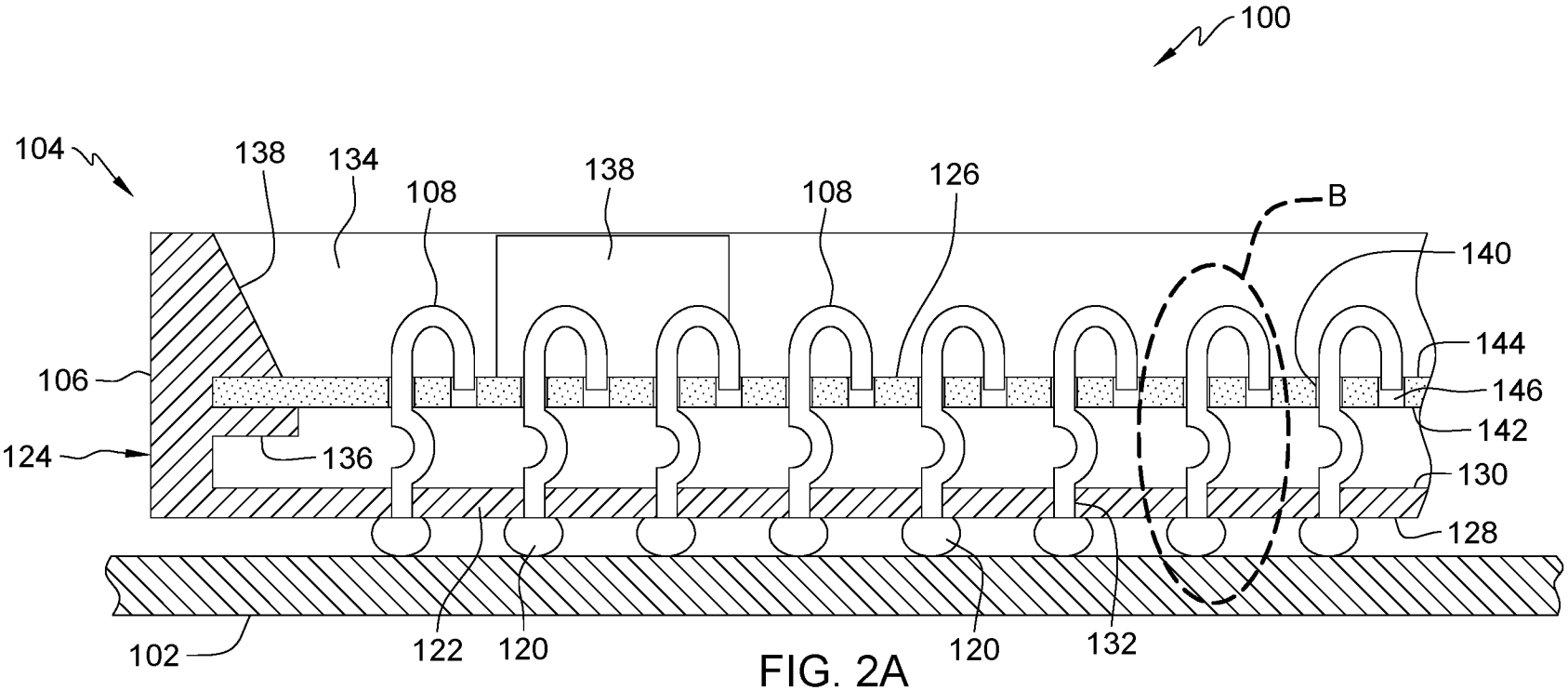
FIG. 2A shows a partial cross-sectional view of the PCB along line A-A in FIG. 1.

FIG. 2A shows a partial cross-sectional view of PCB 100 along line A-A in FIG. 1. In the illustrated embodiment, socket 104 is mounted on substrate 102 with pins 108 electrically connected to conductive tracks 112 (shown in FIG. 1) at solder joints 120, according to methods and arrangements known in the art. Pins 108 are connected to housing 106, and while pins 108 are comprised of electrically conductive material, such as a metal material, housing 106 is comprised of an electrically insulative material, such as a polymer material.

In the illustrated embodiment, housing 106 comprises base 122, riser 124, and wall 126. Base 122 is a sheet that extends laterally and comprises inner face 128, outer face 130, and an array of mounting ports 132 extending therebetween. Pins 108 are about the same size or larger than mounting ports 132 such that pins 108 are secured in base 122 by an interference fit. Riser 124 is integral with base 122 and extends perpendicularly from outer face 130. Riser 124 comprises border 134 with shelf 136 being integral therewith, and shelf 136 extends perpendicularly from border 134 towards the center of socket 104. Riser 124 further comprises blocks 138 which are integral with border 134 and extend towards the center of socket 104. Blocks 138 are located intermittently around border 134 and are spaced apart from shelf 136.

In the illustrated embodiment, wall 126 is a sheet that extends laterally and is positioned within border 134, between blocks 138 and shelf 136, such that the lateral sides of wall 126 are adjacent to border 134. Wall 126 comprises an array of exit ports 140 through wall 126 from interior face 142 to exterior face 144. The array of exit ports 140 is aligned with the array of mounting ports 132. Wall 126 further comprises an array of entrance ports 146 through wall 126 that is offset from the array of exit ports 140. Therefore, the components and configuration of socket 104 allow for wall 126 to be securely spaced apart from base 122, and for pins 108 to be secured in base 122 and still be exposed in order to be electrically connectable with CPU 110 (shown in FIG. 1).

Figure 2B:
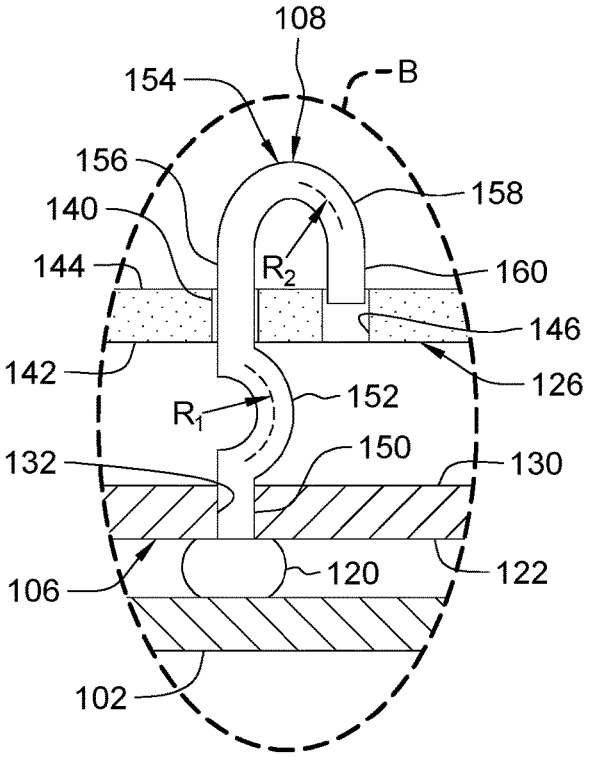
FIG. 2B shows an enlarged view of a pin in region B of FIG. 2A.

FIG. 2B shows an enlarged view of one of the plurality of pins 108 in region B of FIG. 2A. In the illustrated embodiment, pin 108 is a monolithic wire that is comprised of three adjacent sections: stud 150, spring 152, and contact 154. Stud 150 is a straight section that is press-fit into mounting port 132 of base 122, and solder joint 120 is connected to stud 150. Spring 152 is connected to stud 150 and has a reverse "c" shape bend with a constant radius of curvature $R_1$. One end of spring 152 is adjacent to outer face 130 of base 122, and the opposite end of spring 152 is adjacent to interior face 142 of wall 126. Contact 154 is connected to spring 152 and has an "n" shape comprised of exiting segment 156, bent segment 158, and entering segment 160. Exiting segment 156 is straight, positioned in exit port 140, and thinner than exit port 140. Bent segment 158 that is connected to exiting segment 156 and has a constant radius of curvature $R_2$, which is equal to radius of curvature $R_1$ of spring 152 in some embodiments. Entering segment 160 is straight, positioned in entrance port 146, and thinner than entrance port 146.

In the illustrated embodiment, pin 108 is 1 mm wide and 5 mm tall. Mounting port 132 is also 1 mm wide, and exit ports 140 and entrance ports 146 are 1.2 mm wide. Thereby, stud 150 is anchored in base 122, but contact 154 has a clearance fit and can move with respect to wall 126. The relatively small gap between pin 108 and exit port 140 (and entrance port 146) allows longitudinal movement between pin 108 and wall 126 (i.e., in a direction perpendicular to wall 126) but prevents a significant amount of lateral movement therebetween (i.e., in a direction parallel to wall 126). The aforementioned dimensions are provided for the purposes of discussion of one exemplary embodiment only, and other dimensions and aspect ratios are possible in other embodiments.

The components and configuration of socket 104 allow for pin 108 to be supported laterally by wall 126, for example, if an operator or a tool incidentally brushes across contact 154. In addition, pin 108 can move longitudinally with respect to wall 126, for example, if CPU 110 is pressing on contact 154 when CPU 154 is installed in socket 104 (shown in FIG. 2A). However, the "n" shape of contact 154 prevents pin 108 from moving entirely beneath exterior face 144 of wall 126. In other words, the "n" shape of contact 154 prevents wall 126 from lifting off of one or more of pins 108.

FIG. 2B shows one embodiment of the present disclosure, to which there are alternative embodiments. For example, radius of curvature $R_2$ can be different than radius of curvature $R_1$. For another example, spring 152 can be offset from base 122 and/or wall 126 with stud 150 and/or exiting segment 156 being longer than in FIG. 2B, respectively. For yet another example, entrance ports 146 can be blind in that they begin in exterior face 144 but do not penetrate all of the way through wall 126 to interior face 142.

Figure 2C:
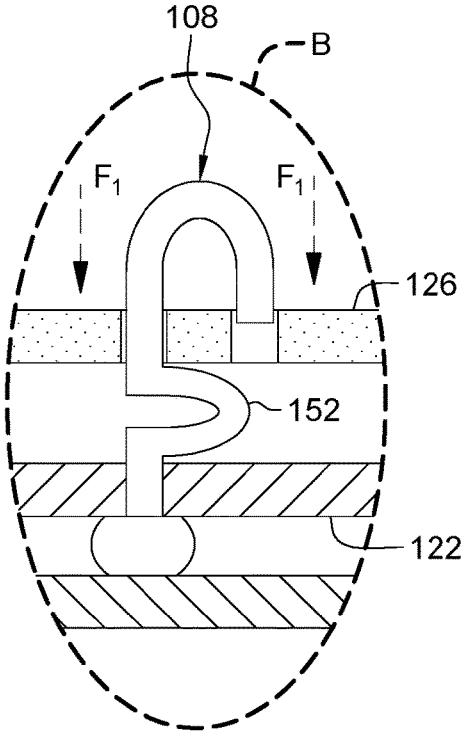
FIG. 2C shows an enlarged view of a wall in region B of FIG. 2A being compressed.

FIG. 2C shows an enlarged view of one of the plurality of pins 108 in region B of FIG. 2A being compressed. In the illustrated embodiment, there is force $F_1$ being exerted on wall 126 which could occur, for example, during manufacturing of PCB 100 (shown in FIG. 1). While wall 126 is supported near border 134 (shown in FIG. 2A), the center of wall 126 can be significantly distal from supporting structures, so wall 126 is more likely to longitudinally displace in the direction of force $F_1$.

In the illustrated embodiment, force F1 has displaced wall 126 toward base 122. This has caused spring 152 in pin 108 to flex. This elastic deformation of spring 152 prevents damage to both pin 108 and wall 126. Thereby, PCB 100 is less likely to require repair if contacted, for example, during manufacturing.

Figure 2D:
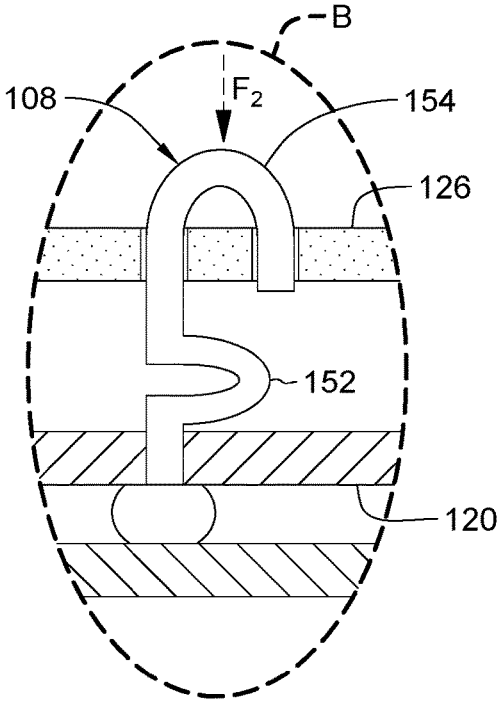
FIG. 2D shows an enlarged view of the pin in region B of FIG. 2A being compressed.

FIG. 2D shows an enlarged view of pin 108 in region B of FIG. 2A being compressed. In the illustrated embodiment, there is force $F_2$ being exerted on pin 108 which could occur, for example, during manufacturing of PCB 100 or installation of CPU 110 (shown in FIG. 1).

In the illustrated embodiment, force $F_2$ has displaced contact 154 toward wall 126. This has caused spring 152 in pin 108 to flex. This elastic deformation of spring 152 prevents damage to both pin 108 and wall 126. Thereby, PCB 100 is less likely to require repair if contacted, for example, during manufacturing. In addition, the elastic deformation of spring 152 allows contact 154 to maintain its shape and can hold contact 154 against CPU 110 to maintain an electrical connection therebetween.

Figure 3:
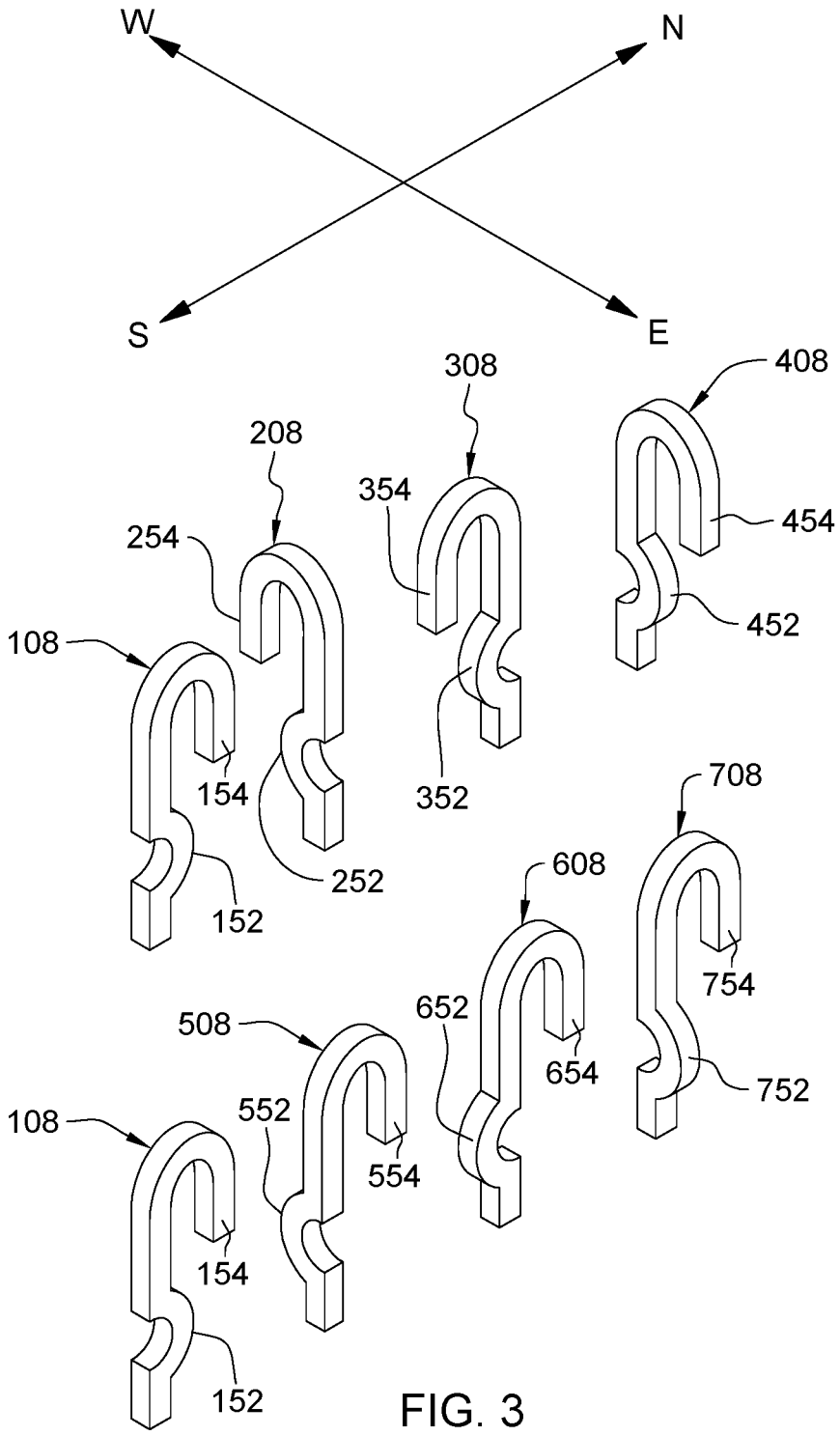
FIG. 3 shows various embodiments of pins.

FIG. 3 shows pins 208, 308, 408, 508, 608, and 708, which are alternate embodiments to pin 108. FIG. 3 includes a directional legend denoting north (N), south (S), east (E), and west (W). These directions are included for the purposes of discussion of FIG. 3 and should not be considered as limiting.

In FIG. 3, pin 108 is included twice for reference wherein spring 152 and contact 154 extend north. Pins 208, 308, and 408 show alternatives to pin 108 wherein springs 252, 352, and 452 extend in the same directions as contacts 254, 354, and 454, although the directions of extension are west, south, and east, respectively. Pins 508, 608, and 708 are further alternatives to pin 108 wherein springs 552, 652, and 752 extend west, south, and east, respectively, although contacts 554, 654, and 754 all extend north.

The array of pins shown in the example of FIG. 1 is composed solely of pins 108. Alternatively, the array of pins 108 can comprise any or all of pins 108-708 in any arrangement. Furthermore, while pins 108-708 have a square cross-section, other cross-sections could be used, such as circular or rectangular.

Figure 4:
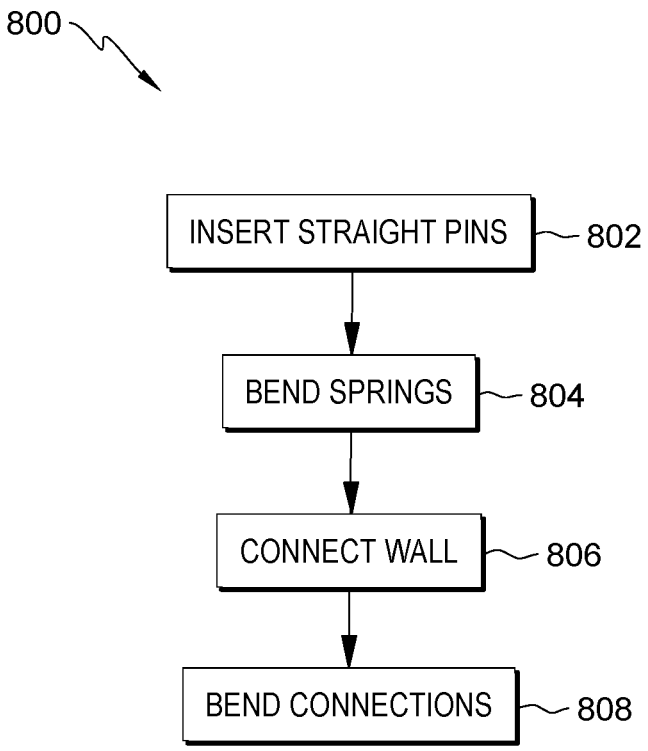
FIG. 4 shows a method of manufacturing a socket.

FIG. 4 shows method 800 of manufacturing socket 104. The description of FIG. 4 will include discussion of various components and features that have been discussed previously (such as socket 104).

At box 802, pins 108 (in the shape of straight wires) are pressed into base 122. At box 804, springs 152 are bent into a predetermined shape and orientation. For example, the springs can be bent into a "c" shape and the spring 152 of each respective pin 108 can be bent in different direction, such as depicted in the example of FIG. 3, or the spring 152 of each respective pin 108 can be bent in the same direction, such as depicted in the example of FIG. 1. At box 806, wall 126 is placed over pins 108 and clipped onto shelf 136 by passing blocks 138. At box 808, contacts 154 are bent into a predetermined shape and orientation. For example, as discussed above, the contacts 154 can be bent into an "n shape". Additionally, the contact 154 of each respective pin 108 can be bent in the same direction as the corresponding spring 152 of the respective pin, in some embodiments. In other embodiments, the contact 154 of each respective pin may or may not be bent in the same direction as the corresponding spring 152 of the respective pin 108, as depicted in the example of FIG. 3.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A socket for an electronic device comprising:
a housing comprising:
a base extending laterally and having an inner face and an outer face;
a riser connected to the base and extending away from the outer face;
a wall extending laterally, connected to the riser, and having an exterior face and an interior face that faces the outer face of the base;
a first array of mounting ports extending through the base from the inner face to the outer face; and
a second array of exit ports extending through the wall from the interior face to the exterior face; and
a plurality of pins connected to the housing, wherein each of the plurality of pins comprises:
a first portion extending at least partially though one mounting port of the first array;
a second portion connected to the first portion and extending between the base and the wall;
a third portion connected to the second portion and extending through one exit port of the second array.

2. The socket of claim 1, wherein:
the housing further comprises:
a third array of entrance ports extending into the wall from the exterior face and spaced apart from the second array; and
each of the plurality of pins further comprises:
a fourth portion connected to the third portion and extending along the exterior face; and
a fifth portion connected to the fourth portion and extending at least partially through one entrance port of the third array.

3. The socket of claim 2, wherein the third array of entrance ports extends through the interior face.

4. The socket of claim 1, wherein the second portion has a first bend.

5. The socket of claim 4, wherein the first bend has a first constant radius of curvature.

6. The socket of claim 1, wherein the fourth portion has a second bend.

7. The socket of claim 6, wherein the second bend has a second constant radius of curvature.

8. The socket of claim 1, wherein the riser comprises:
a shelf configured to restrain movement of the wall towards the base; and
a block spaced outward of the shelf and configured to restrain movement of the wall away from the base.

9. An apparatus comprising:
a substrate having conductive tracks; and
a socket mounted to the substrate and configured to connect to an electronic device, the socket comprising:
a housing comprising:
a base including a first array of ports;
a riser connected to the base and extending therefrom; and
a wall connected to the base, extending therefrom, and spaced apart from the base, the wall including a second array of ports;
a plurality of pins, wherein each of the plurality of pins is positioned in one of the first array of ports and one of the second array of ports.

10. The apparatus of claim 9, wherein:
the wall further comprises a third array of ports; and
each of the plurality of pins is further positioned in one of the third array of ports.

11. The apparatus of claim 9, wherein the riser comprises:
a border;
a shelf extending from the border; and
a plurality of blocks extending from the border and spaced apart from the shelf;
wherein the wall is positioned between the shelf and the plurality of blocks.

12. The apparatus of claim 9, wherein each of the plurality of pins comprises a straight section, a c-shaped section connected to the first section, and an n-shaped section connected to the c-shaped section.

13. The apparatus of claim 12, wherein one end of the c-shaped section is positioned adjacent to the base and an opposite end of the c-shaped section is positioned adjacent to the wall.

14. The apparatus of claim 12, wherein the c-shaped section has a first constant radius of curvature.

15. The apparatus of claim 12, wherein a bent portion of the n-shaped section has a second constant radius of curvature.

16. The apparatus of claim 9, wherein a plurality of lateral sides of the wall are adjacent to the riser.

17. The apparatus of claim 9, wherein each pin has an interference fit with the base and a clearance fit with the wall.

* * * * *